US006009942A

United States Patent [19]

Williamson

[11] Patent Number: 6,009,942

[45] **Date of Patent: *Jan. 4, 2000**

[54] WYE BLOCK HAVING A ROTARY GUIDE INCORPORATED THEREIN

[75] Inventor: Jimmie R. Williamson, Carrollton, Tex.

[73] Assignee: Halliburton Energy Services, Inc., Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/872,115

[22] Filed: Jun. 10, 1997

[51] Int. Cl.[7] ..... E21B 34/12; E21B 34/14

[52] U.S. Cl. ..... 166/117.5; 166/117.7; 166/313; 166/331; 166/332.2

[58] Field of Search ..... 166/50, 117.5, 166/117.7, 241.1, 313, 331, 332.2, 373, 386

[56] References Cited

U.S. PATENT DOCUMENTS

| | | | |
|---|---|---|---|
| 2,488,931 | 11/1949 | Penick | 166/313 |
| 3,442,327 | 5/1969 | Graff | 166/331 |
| 3,960,366 | 6/1976 | Abney et al. | 166/331 |
| 4,133,418 | 1/1979 | Van Bilderbeek | 166/153 |
| 4,291,724 | 9/1981 | Miller | 166/70 |
| 4,440,222 | 4/1984 | Pullin | 166/117.5 |
| 5,129,459 | 7/1992 | Breese et al. | 166/339 |
| 5,311,936 | 5/1994 | McNair et al. | 166/50 |
| 5,377,762 | 1/1995 | Turner | 166/339 |
| 5,427,177 | 6/1995 | Jordan, Jr. et al. | 166/50 |
| 5,454,430 | 10/1995 | Kennedy et al. | 166/50 |
| 5,474,131 | 12/1995 | Jordan, Jr. et al. | 166/313 |
| 5,732,773 | 3/1998 | Parks et al. | 166/117.5 |

*Primary Examiner*—George Suchfield
*Attorney, Agent, or Firm*—Paul I. Herman; Marlin R. Smith

[57] ABSTRACT

A wye block apparatus provides selective physical access to multiple downhole tubing strings while permitting fluid communication with each of them. In a described embodiment, a wye block apparatus is resistant to malfunction due to debris therein, in substantial part by providing an elongated deflection member which is axially rotatable within an outer housing assembly. A J-slot device is utilized to rotate the deflection member in response to axial displacement of an operating sleeve. Rotation of the deflection member selectively aligns a guide surface formed on the deflection member with one of the tubing strings attached to the wye block apparatus.

25 Claims, 12 Drawing Sheets

WYE BLOCK HAVING A ROTARY GUIDE INCORPORATED THEREIN

BACKGROUND OF THE INVENTION

The present invention relates generally to equipment utilized in operations in subterranean wells and, in an embodiment described herein, more particularly provides a wye block apparatus having a rotary guide incorporated therein.

It is well known in the art to provide a wye block where access to more than one wellbore or portion of a wellbore is desired. For example, where a lateral wellbore has been drilled intersecting a parent wellbore, it is sometimes desirable to install a tubing string into the lateral wellbore, install another tubing string into the parent wellbore below the intersection of the lateral and parent wellbores, and to connect these to a tubing .string extending upward through the parent wellbore and to the earth's surface. An item of equipment which permits interconnection of these three tubing strings is known as a wye block.

One form of a wye block apparatus which permits selective re-entry into a lateral or lower parent wellbore is disclosed in U.S. Pat. No. 5,427,177, the disclosure of which is incorporated herein by this reference. This wye block apparatus includes a flapper which is rotated about a lateral axis in order to provide selective access to either of two lower wellbores. Unfortunately, this design requires the flapper to rotate about a pin installed laterally between two lower openings, and also requires the upper end of the flapper to sweep laterally across the interior of the wye block apparatus. Consequently, this apparatus is sensitive to debris, which may cause the apparatus to malfunction, thereby deleteriously prohibiting access to one or more of the lower wellbores.

From the foregoing, it can be seen that it would be quite desirable to provide a wye block apparatus which is not sensitive to debris therein, which does not have a member that must sweep laterally across the interior of the apparatus, and which does not require complex mechanisms for its operation, but which is convenient in its operation. It is accordingly an object of the present invention to provide such a wye block apparatus.

SUMMARY OF THE INVENTION

In carrying out the principles of the present invention, in accordance with an embodiment thereof, a wye block apparatus is provided which conveniently permits selective physical access to one of two fluid passages, but which does not require complex mechanisms and is relatively insensitive to debris therein.

In broad terms, a wye block apparatus is provided which includes an outer housing assembly, a deflection member and a J-slot device. The J-slot device and the deflection member are disposed within the outer housing assembly. The deflection member is rotatable about its longitudinal axis within the outer housing assembly in order to align a guide surface formed on the deflection member with a selected one of two fluid passages. The deflection member is also provided with openings formed generally laterally therethrough, so that fluid communication is maintained with the nonselected fluid passage.

The J-slot device includes an operating sleeve, a J-slot sleeve and a latch member. The operating sleeve is axially displaceable within the outer housing assembly, but is prevented from rotating therein. The J-slot sleeve is secured to the deflection member and has a series of J-slots formed therein. A series of lugs formed on the operating sleeve are in cooperative engagement with the J-slots so that, when the operating sleeve is axially displaced, the J-slot sleeve is made to axially rotate within the outer housing assembly, thereby causing axial rotation of the deflection member.

The deflection member has the longitudinally inclined guide surface formed thereon axially between an upper generally tubular portion and a lower generally conical shaped end. The conical end is received in a complementarily shaped conical recess formed in the outer housing assembly laterally between the two fluid passages. The tubular portion is received in an upper fluid passage which is connectable to a tubing string extending to the earth's surface. Thus, as the deflection member is rotated about its longitudinal axis, the guide surface is selectively aligned with one of the fluid passages adjacent its lower end, while its upper tubular portion remains aligned with the upper fluid passage.

The operating sleeve is axially displaceable through utilization of a conventional shifting tool or actuator. Thus, no specially designed tools are required for its operation. Additionally, the wye block apparatus has few moving parts and is straightforward in its operation.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1A:
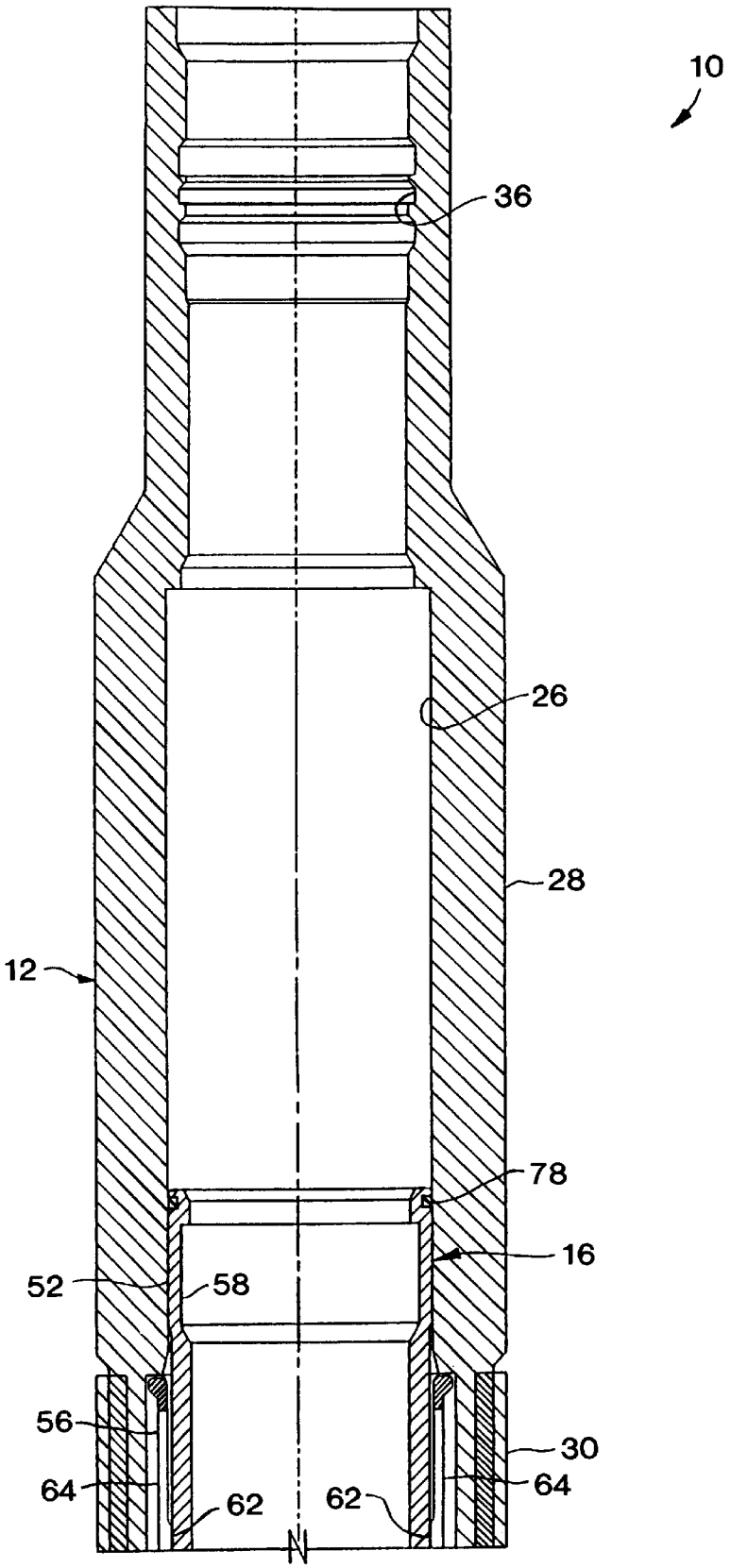
FIGS. 1A–1E are cross-sectional views of successive axial sections of a wye block apparatus embodying principles of the present invention, the apparatus being shown in a first configuration thereof.

Representatively illustrated in FIGS. 1A–1E is a wye block apparatus 10 which embodies principles of the present invention. In the following description of the wye block apparatus 10, directional terms, such as "above", "below", "upper", "lower", etc., are used for convenience in referring to the accompanying drawings. It is to be understood that the various embodiments of the present invention described herein may be utilized in various orientations, such as inclined, inverted, horizontal, vertical, etc., without departing from the principles of the present invention. Additionally, although the apparatus 10 is shown in successive axial sections, it is to be understood that it is actually a continuous assembly.

The wye block apparatus 10 includes an outer housing assembly 12, a deflection member 14, and a J-slot device 16. The J-slot device 16 is utilized to rotate the deflection member 14 within the outer housing assembly 12, so that a guide surface 18 formed on the deflection member is aligned with a selected one of two fluid passages 20, 22, that is, so that a tool or other item of equipment conveyed through the wye block apparatus 10 will be directed to pass through the selected fluid passage. The guide surface 18 is inclined along a longitudinal axis of the deflection member 14 so that it, in effect, serves as a ramp toward the selected fluid passage 20, 22. In an important aspect of the present invention, the J-slot device 16 rotates the deflection member 14 about its longitudinal axis, thereby maintaining an upper generally tubular portion 24 of the deflection member coaxially aligned with an upper fluid passage 26 formed axially within the outer housing assembly 12.

The outer housing assembly 12 includes a generally tubular upper adapter 28, a generally tubular upper housing 30, a generally tubular lower housing 32, and a wye block 34. The upper adapter 28 is threadedly connected to the upper housing 30, and may be provided with appropriate threads, etc. at its upper end for interconnection to a tubing string, coiled tubing, or other fluid conduit. A conventional internal latch profile 36 is formed in the upper adapter 28 for landing plugs, flow control devices, actuators, other tools, etc. therein. The connection between the upper adapter 28 and the upper housing 30 may also be provided with a seal therebetween.

The upper and lower housings 30, 32 are threadedly and sealingly connected to each other. A radially enlarged portion 38 of the deflection member 14 is retained axially between the upper and lower housings 30, 32 adjacent the connection therebetween. Although axially retained between the housings 30, 32, the deflection member 14 is still permitted to rotate about its longitudinal axis within the housings.

The lower housing 32 is threadedly connected to the wye block 34, with the deflection member 14 extending into the wye block from the lower housing. The connection between the lower housing 32 and the wye block 34 may also be provided with a seal therebetween.

The wye block 34 forms a transition between the upper fluid passage 26 and the two lower fluid passages 20, 22. In an example of an intended utilization of the apparatus 10, the upper fluid passage 26 may be in fluid communication with a tubing string (not shown) extending to the earth's surface, and each of the two lower fluid passages 20, 22 may be in fluid communication with one of two wellbores. For example, the fluid passage 20 may be in fluid communication with a lower parent wellbore, and the fluid passage 22 may be in fluid communication with a lateral wellbore which intersects the parent wellbore. In that case, a tubing string 40 threadedly connected to the wye block 34 and in fluid communication with the fluid passage 20 would extend downwardly into the lower parent wellbore, and a tubing string 42 threadedly connected to the wye block and in fluid communication with the fluid passage 22 would extend downwardly into the lateral wellbore. However, it is to be understood that the wye block 34 may be otherwise placed in fluid communication with one or more wellbores, or portions of a wellbore, without departing from the principles of the present invention.

The wye block 34 has a generally conical shaped recess 44 formed internally therein. An apex 46 of the recess 44 is positioned laterally between the fluid passages 20, 22. In another important aspect of the present invention, a lower generally conical shaped end 48 of the deflection member 14 is rotatably received in the apex 46 of the recess 44, thereby securing the end of the deflection member within the wye block 34.

Figure 1B:
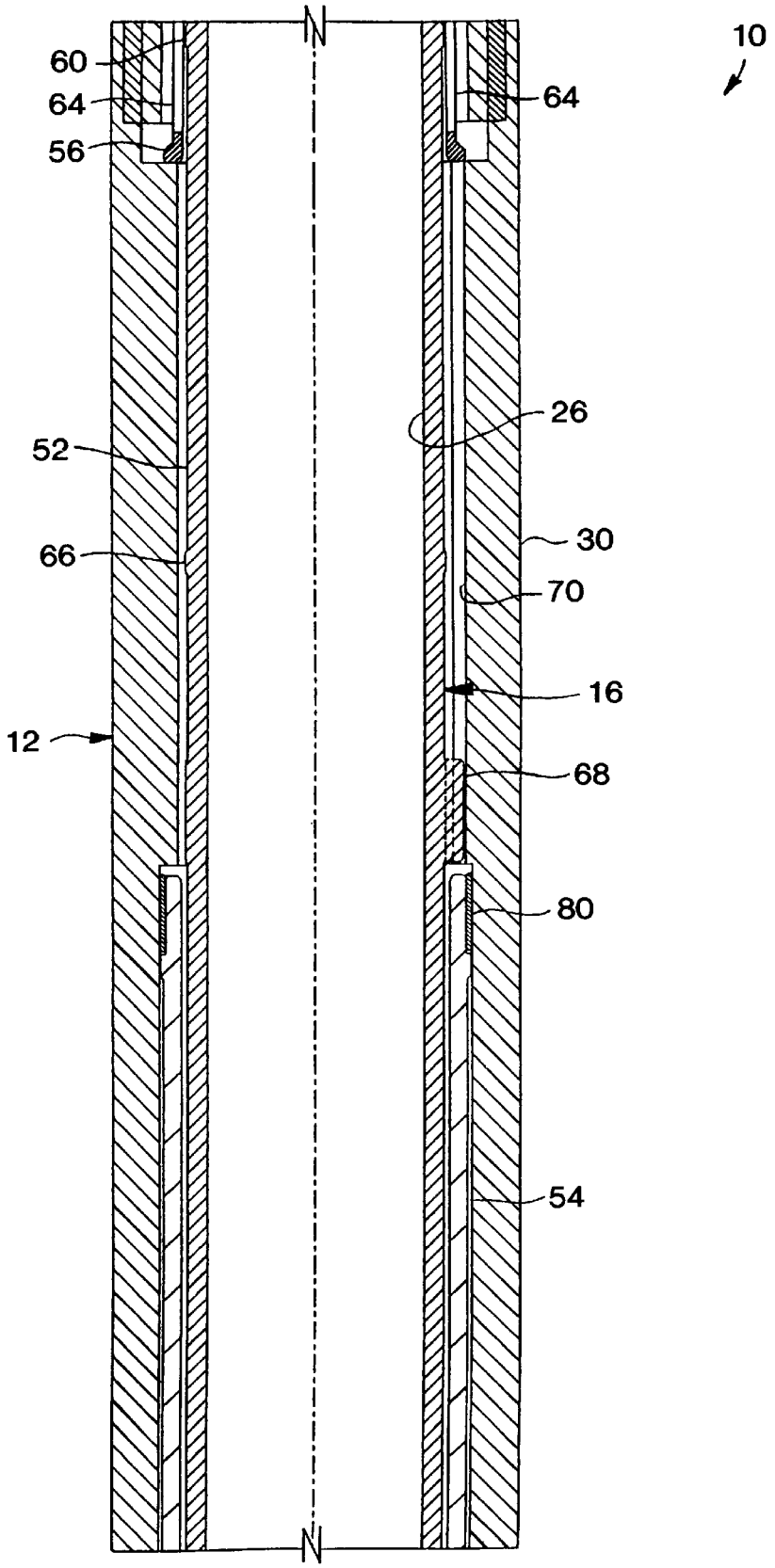
Figure 1C:
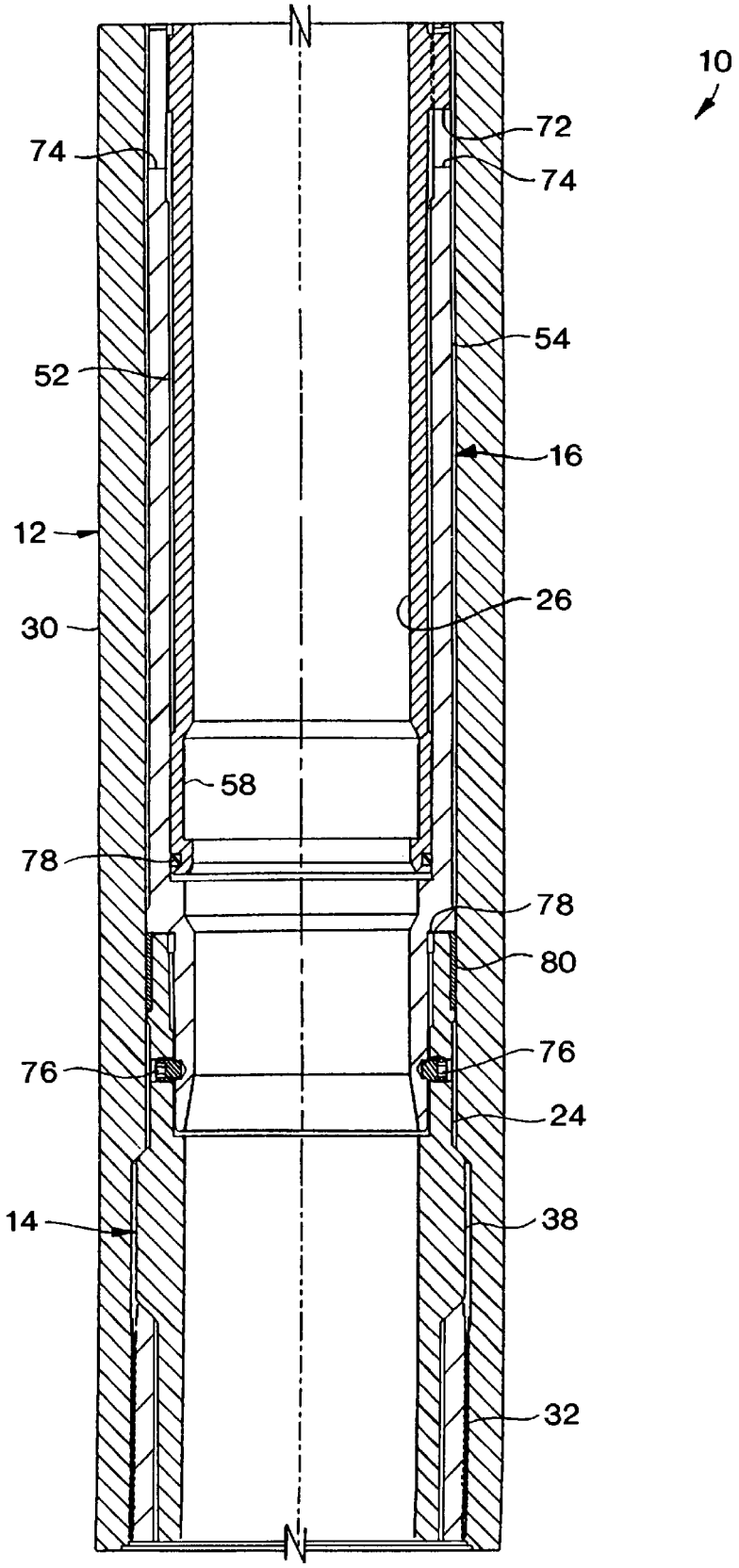
Figure 1D:
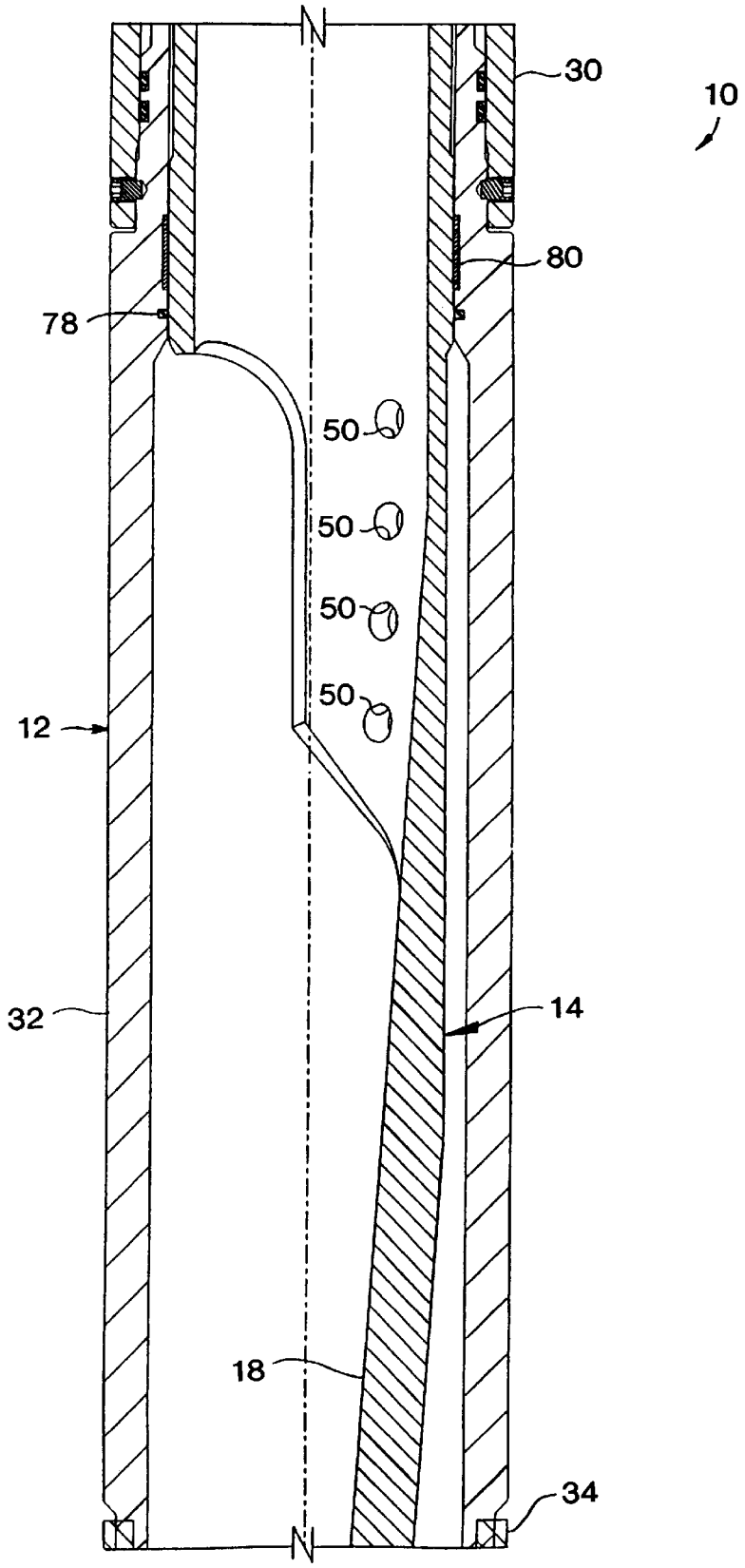
Figure 1E:
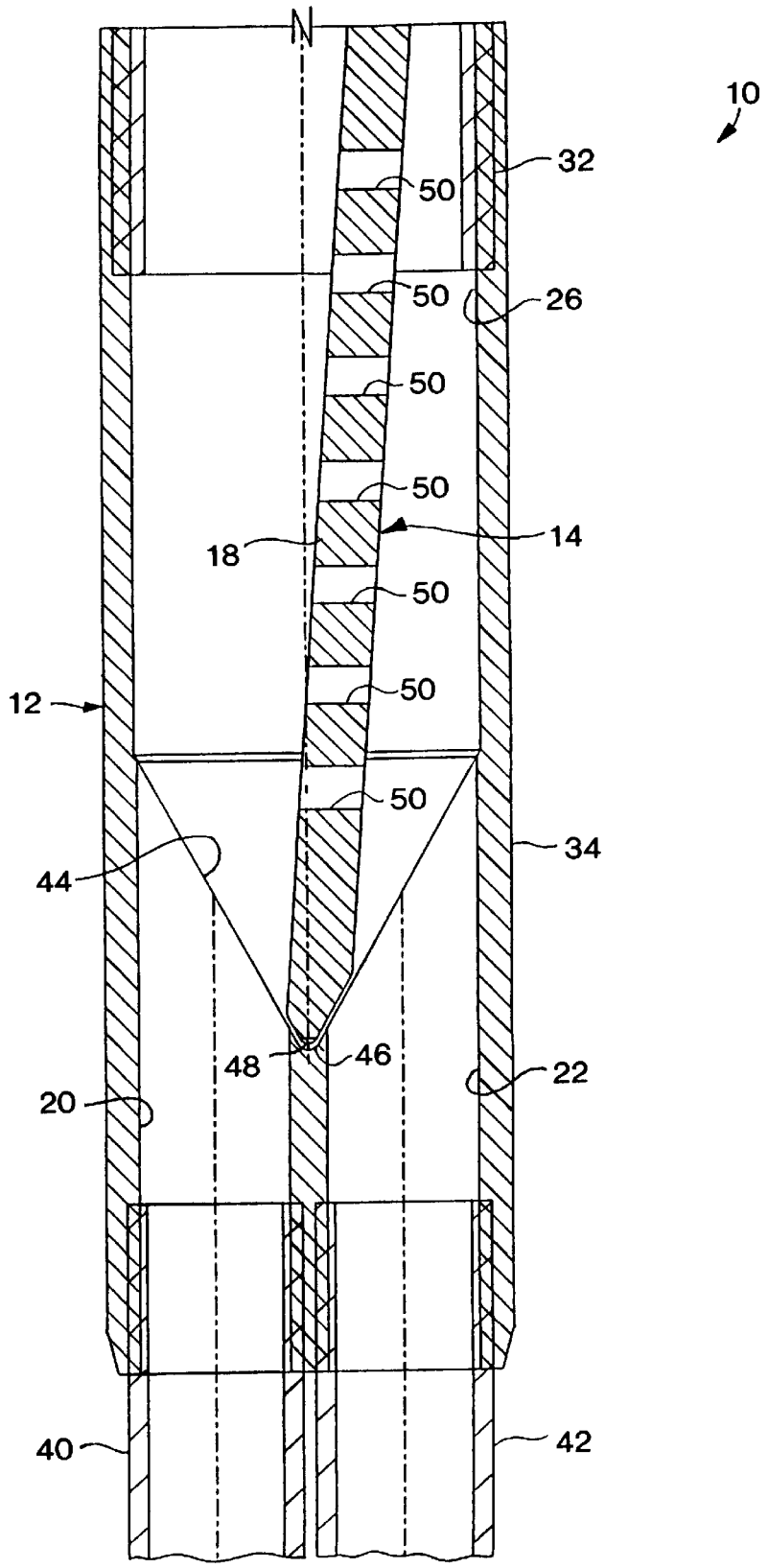
Figure 3A:
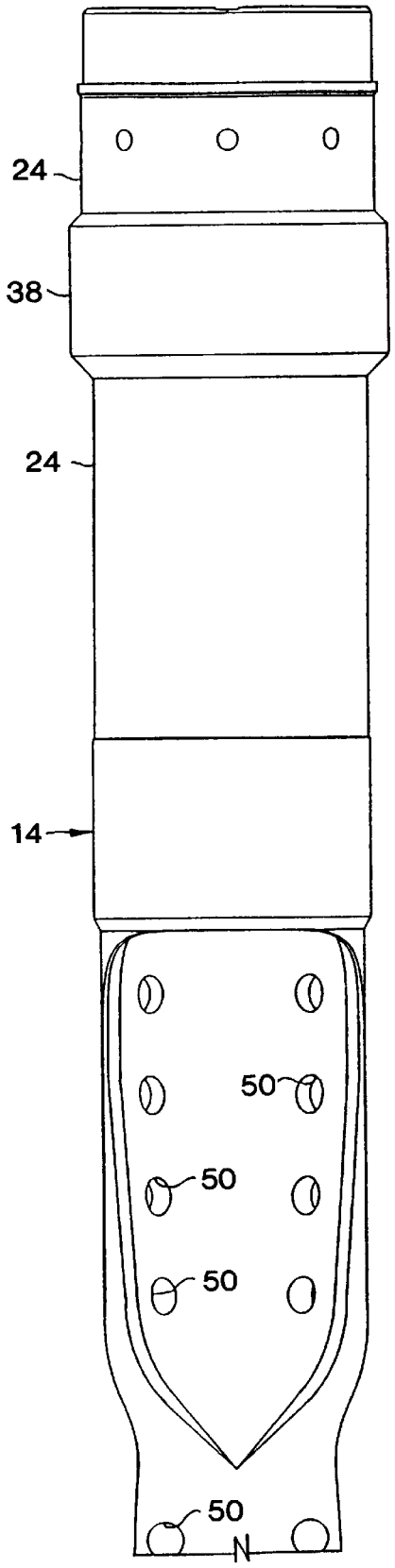
FIGS. 3A–3B are top plan views of a deflector member utilized in the wye block apparatus of FIGS. 1A–1E.
Figure 3B:
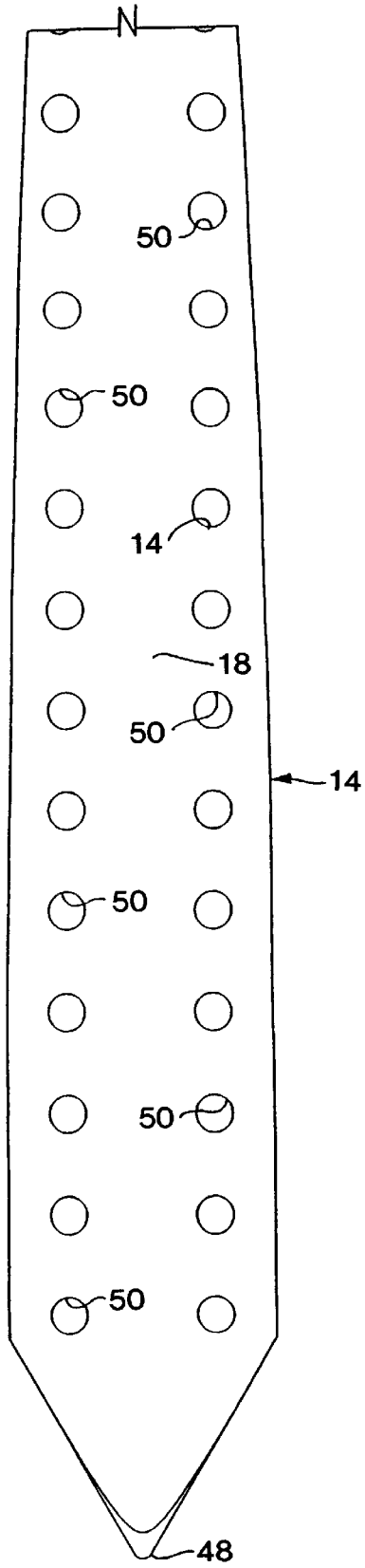

As representatively illustrated in FIGS. 1A–1E, the deflection member 14 is positioned with the guide surface 18 aligned with the fluid passage 20. Thus, if a tool, coiled tubing string, or other item of equipment is lowered through the upper fluid passage 26, it will pass through the upper tubular portion 24 of the deflection member 14 and be guided by the guide surface 18 into the fluid passage 20, and thence into the tubing string 40. Note that, even though the guide surface 18 is aligned with the fluid passage 20, fluid communication is maintained with the fluid passage 22, aided in substantial part by a series of axially spaced apart openings 50 formed through the deflection member 14 adjacent the guide surface. The openings 50 are shown in FIG. 1E laterally offset from their actual positions on the deflection member 14, in order to show the spatial relationship between the openings and the fluid passages 20, 22. The actual positions of the openings 50 may be more clearly seen in FIGS. 3A–3B, in which the deflection member 14 is representatively illustrated apart from the remainder of the wye block apparatus 10.

It will be readily apparent to one of ordinary skill in the art that the deflection member 14 and, therefore, the guide surface 18, may be rotated 180 degrees about its axis to thereby align the guide surface with the fluid passage 22. In this manner, physical access to either of the fluid passages 20, 22 may be achieved, without restricting fluid communication with either of them. As mentioned hereinabove, it is the J-slot device 16 which selectively rotates the deflection member 14 so that the guide surface 18 is aligned with a desired one of the fluid passages 20, 22.

The J-slot device 16 includes an inner operating sleeve 52, an outer J-slot sleeve 54, and a latch member 56. The operating sleeve 52 is generally tubular and is axially reciprocably disposed within the upper adapter 28 and upper housing 30. Conventional shifting profiles 58 are formed internally on the operating sleeve 52 and are oppositely oriented with respect to each other. The shifting profiles 58 permit the operating sleeve 52 to be axially displaced within the outer housing assembly 12 by a conventional shifting tool conveyed on wireline, slickline, coiled tubing, etc.

As shown in FIGS. 1A–1C, the operating sleeve 52 is in an axially downwardly disposed position. The operating sleeve 52 is releasably maintained in this position by the latch member 56 which is engaged with a radially enlarged surface 60 formed externally on the operating sleeve. The latch member 56 has radially reduced surfaces 62 formed internally on a series of circumferentially spaced apart resilient collets 64. Thus, when it is desired to upwardly displace the operating sleeve 52, a shifting tool (not shown) may be engaged with the upper profile 58 and an upwardly directed axial force may be applied to the operating sleeve to radially outwardly deflect the collets 64 and permit the enlarged surface 60 to pass radially beneath the surfaces 62. Note that another radially enlarged surface 66 is formed on the operating sleeve 52 axially spaced apart from the surface 60, for engagement with the latch member 56 when the operating sleeve is in its axially upwardly disposed position as described more fully hereinbelow. However, it is to be clearly understood that the latch member 56, or another suitable latch member, may otherwise engage the operating sleeve 52. For example, instead of enlarged surfaces 60, 66, the operating sleeve 52 may be provided with detents or radially reduced surfaces, etc., for engagement with the latch member 56.

Figure 2A:
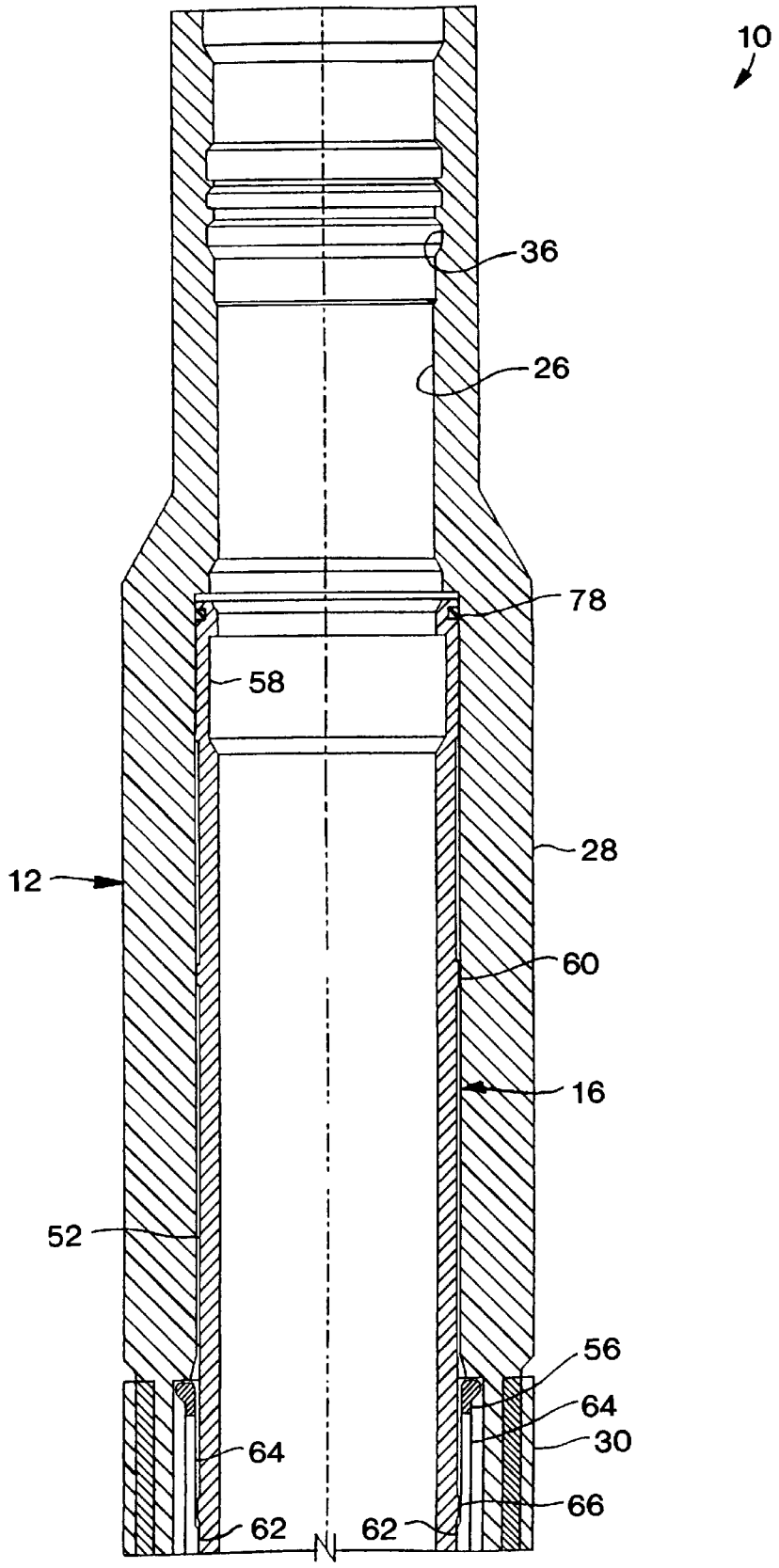
FIGS. 2A–2E are cross-sectional views of successive axial sections of the wye block apparatus of FIGS. 1A–1E, the apparatus being shown in a second configuration thereof.
Figure 2B:
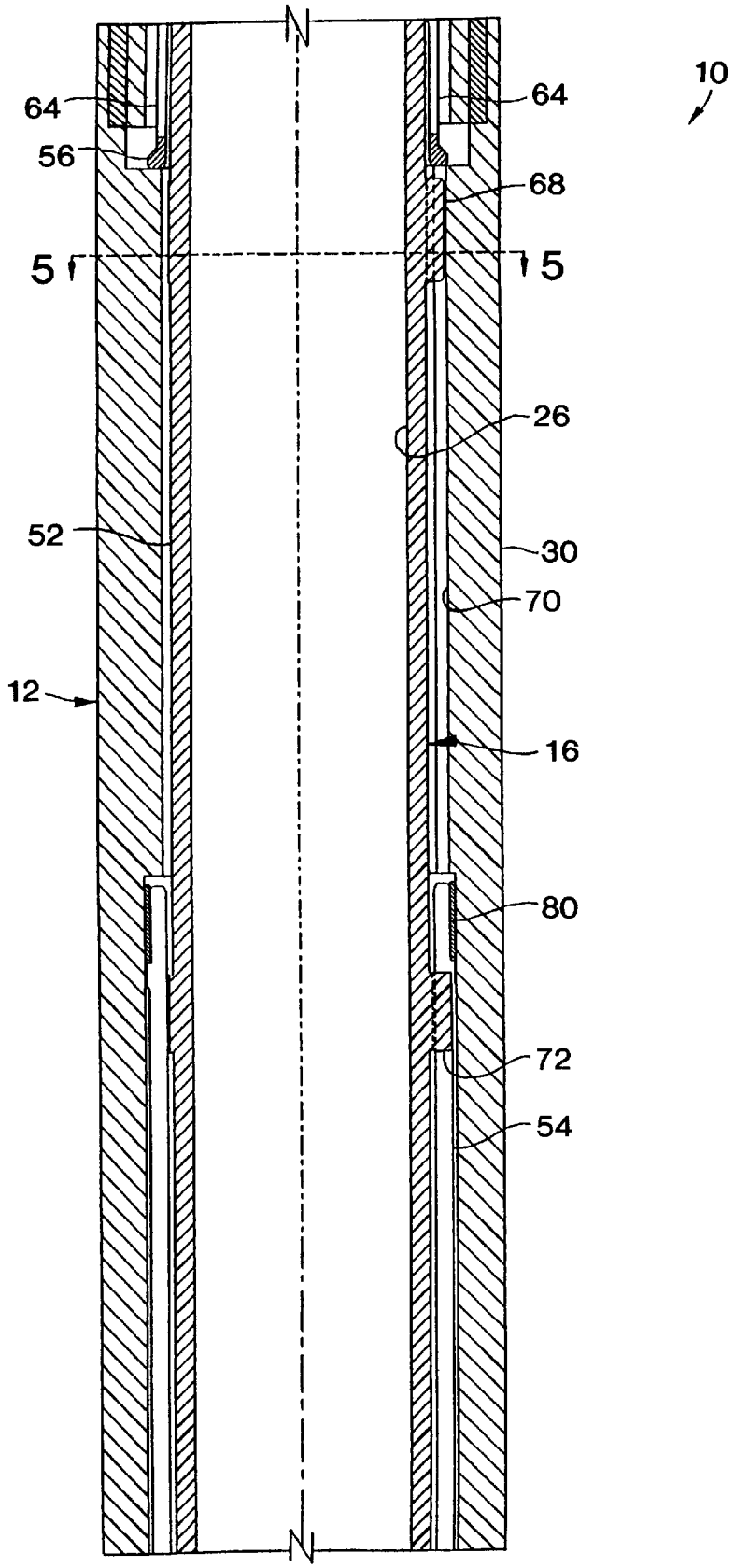
Figure 2C:
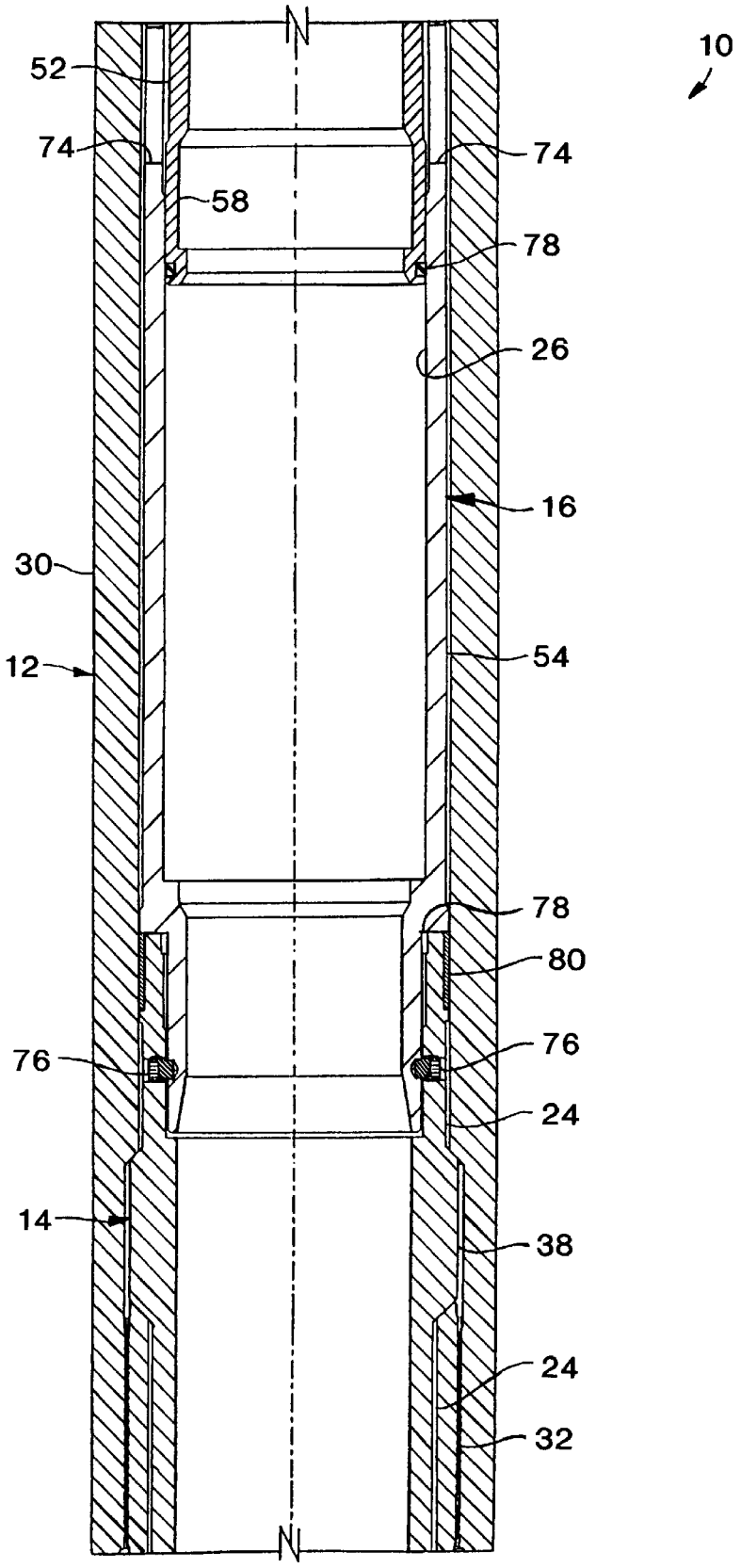
Figure 2D:
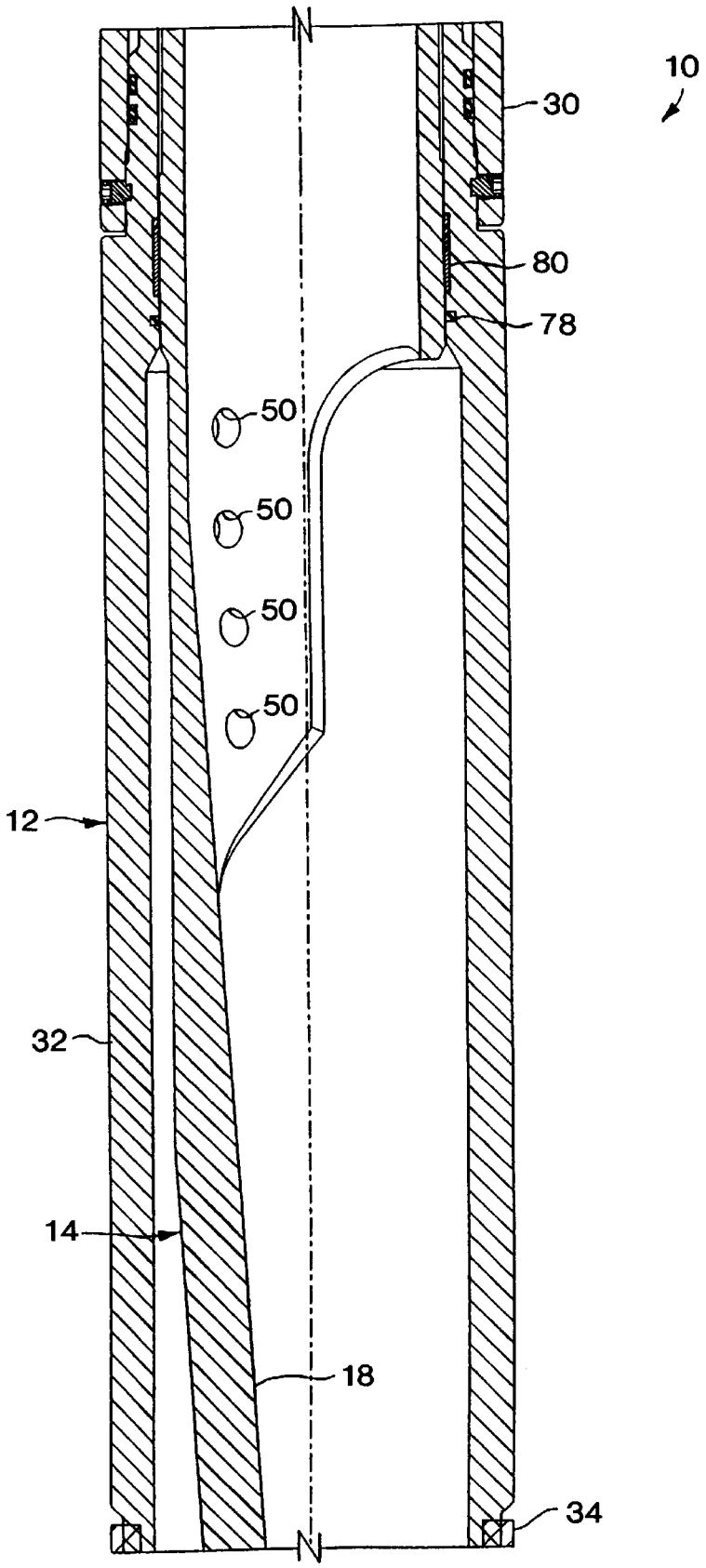
Figure 2E:
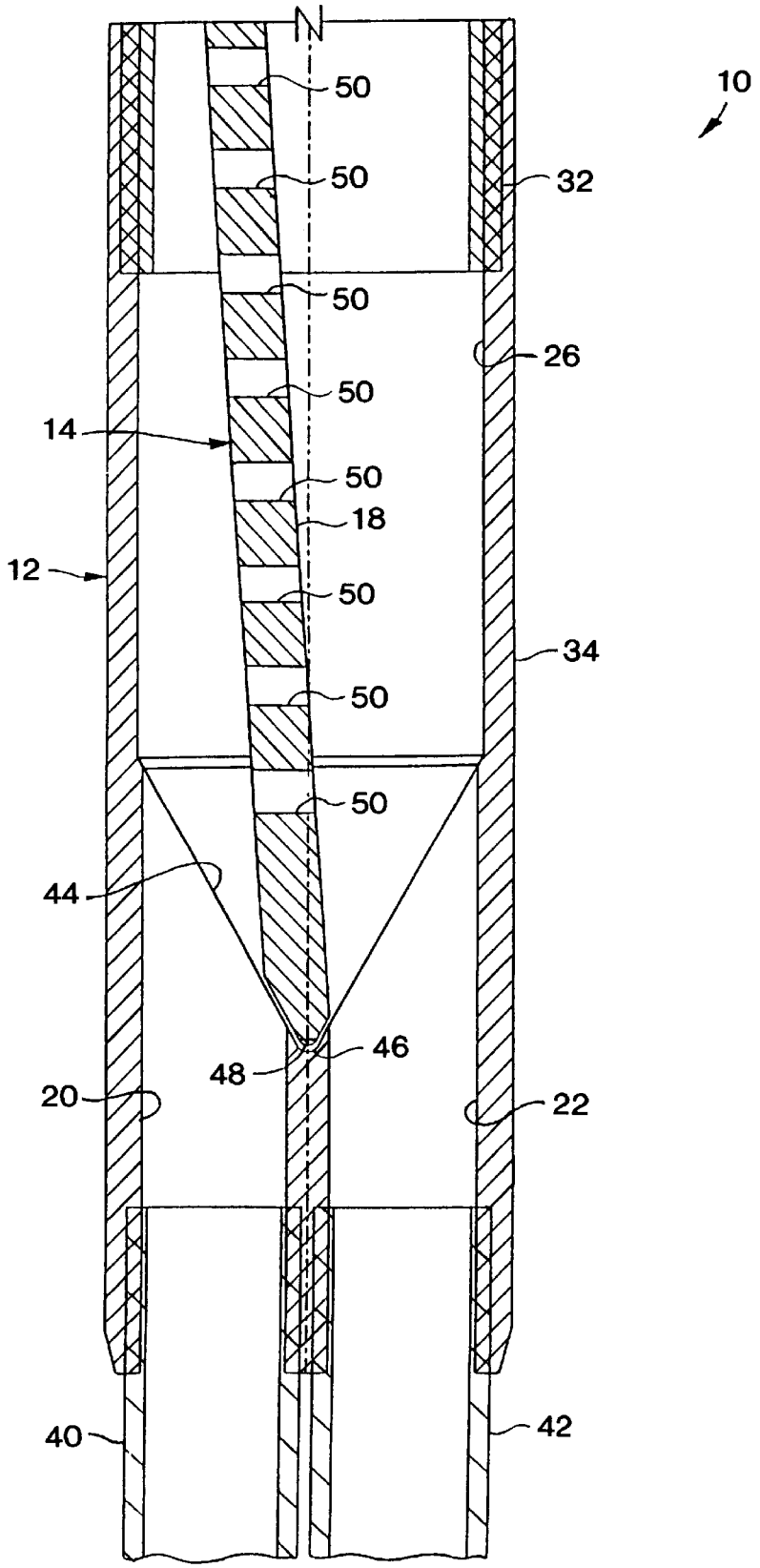
Figure 5:
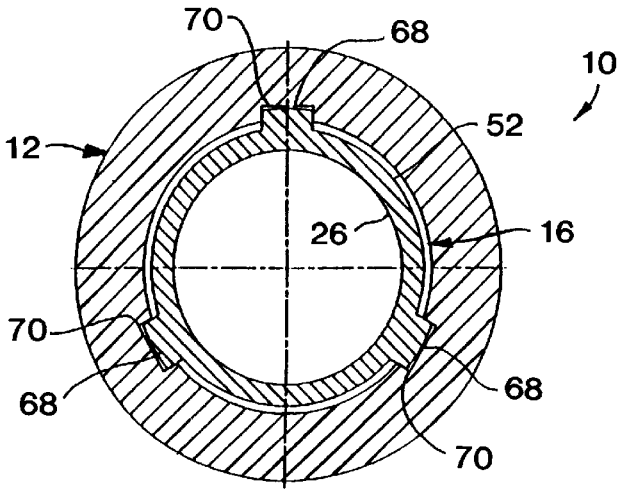
FIG. 5 is cross-sectional view of the wye block apparatus of FIGS. 1A–1E, taken along line 5—5 of FIG. 2B.

The operating sleeve 52 has a series of axially extending and circumferentially spaced apart splines 68 formed externally thereon. The splines 68 are axially slidingly engaged in complementarily shaped grooves 70 formed internally on the upper housing 30. In this manner, the operating sleeve 52 is prevented from rotating within the apparatus 10. Only one each of the splines 68 and grooves 70 is visible in FIG. 1B, but in FIG. 5, which is a cross-sectional view taken along line 5—5 of FIG. 2B, it may be clearly seen that the representatively illustrated embodiment of the apparatus 10 includes three each of the splines and grooves. Thus, the operating sleeve 52 is axially reciprocable within the outer housing assembly 12, but is constrained from axially rotating therein.

The operating sleeve 52 also includes a series of circumferentially spaced apart lugs 72 formed externally thereon, only one of which is visible in FIG. 1C. Each of the lugs 72 is slidingly disposed within a helical slot 74 formed through the J-slot sleeve 54. The slots 74 are of the type well known to those of ordinary skill in the art as J-slots, whereby axial displacement of one member is translated into rotational displacement of another member. In the representatively illustrated apparatus 10, axial displacement of the operating sleeve 52 is translated into rotational displacement of the J-slot sleeve 54, due to engagement of the lugs 72 with the slots 74.

The J-slot sleeve 54 is threadedly connected to the deflection member 14. A series of circumferentially spaced apart set screws 76 are installed through the deflection member 14 and into the J-slot sleeve 54 to prevent relative rotation between the J-slot sleeve and the deflection member. Prior to installation of the set screws 76, the J-slot sleeve 54 and deflection member 14 are rotationally aligned with each other so that, when the operating sleeve 52 is in its downwardly disposed position, the guide surface 18 is aligned with the fluid passage 20.

Note that in various locations within the apparatus 10, circumferential debris barriers or wiper rings 78 are provided to ensure smooth operation of the apparatus. Additionally, the applicant prefers that a lubricant, such as grease, be installed in all voids radially between the outer housing assembly 12, and the operating sleeve 52 and J-slot sleeve 54. For further ease of rotating the J-slot sleeve 54 and deflection member 14 within the outer housing assembly 12, circumferential bushings or bearings 80 are provided. The bushings 80 may be of the type known as Turcite Slydring or Turcon Glydring. It is to be clearly understood, however, that it is not necessary for the debris barriers, wiper rings, bearings, or bushings to be provided in the apparatus 10 in keeping with the principles of the present invention.

Referring additionally now to FIGS. 2A–2E, the apparatus 10 is representatively illustrated in a configuration in which the deflection member 14 has been rotated axially by approximately 180 degrees within the outer housing assembly 12, as compared to that shown in FIGS. 1A–1E. In order to rotate the deflection member 14, the operating sleeve 52 has been axially upwardly displaced by engaging it with, for example, a conventional shifting tool, and applying an axially upwardly directed force thereto. Such axial displacement of the operating sleeve 52 has been translated into rotational displacement of the J-slot sleeve 54, thereby causing rotation of the deflection member 14. Note that the deflection member 14 is not required to sweep laterally across the fluid passage 26, or rotate about a pin laterally disposed therein, rather the deflection member merely rotates about its own longitudinal axis and is, therefore, resistant to malfunction due to debris in the apparatus 10.

The operating sleeve 52 is now releasably maintained in its upwardly disposed position by the latch member 56. The collets 64 are now engaged with the surfaces 66 to prevent downward displacement of the operating sleeve 52.

The guide surface 18 is now aligned with the fluid passage 22. Thus, if a tool or other item of equipment is displaced axially through the apparatus 10, it will pass through the fluid passages 26, 22, and will not pass through the fluid passage 20. Note, however, that the fluid passage 20 is still in fluid communication with the fluid passage 26.

The conical end 48 of the deflection member 14 is still retained within the apex 46 of the conical recess 44, thereby permitting rotation of the deflection member therein, but preventing lateral displacement of the deflection member relative to the wye block 34. It will be readily apparent to one of ordinary skill in the art that such function could also be provided by a cylindrical or otherwise shaped end formed on the deflection member 14 and a cylindrical or otherwise shaped recess formed in the wye block 34, and that the recess could be formed instead on the deflection member for engagement with a projection disposed within the wye block, etc. However, the applicant prefers the illustrated conical shaped end 48 and recess 46 for ease of assembly, reduced friction, resistance to fouling by debris, etc.

Figure 4:
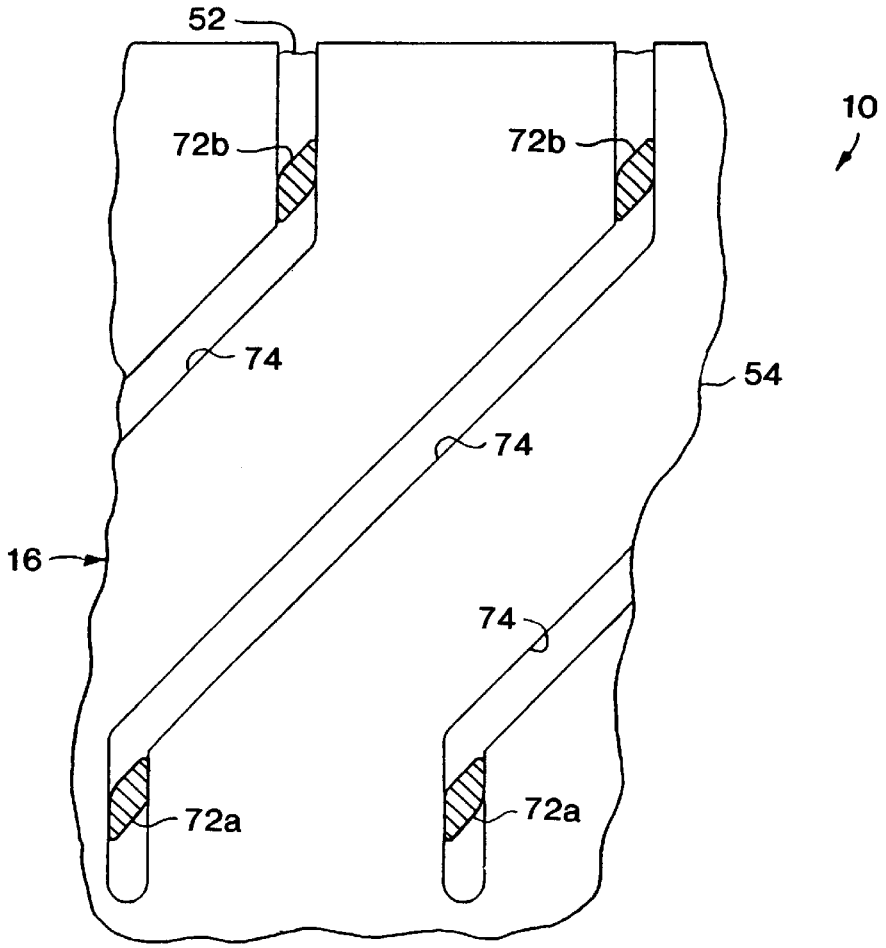
FIG. 4 is a circumferential plan view of a J-slot utilized in the wye block apparatus of FIGS. 1A–1E.

Axial rotation of the J-slot sleeve 54 in response to axial displacement of the operating sleeve 52 may be more fully understood by reference to FIG. 4, wherein an axial portion of the operating and J-slot sleeves is representatively illustrated apart from the remainder of the apparatus 10. In FIG. 4, the sleeves 52, 54 are viewed circumferentially, that is, as if they have been "unrolled" and are now laid flat, instead of in their actual tubular form.

It may now be seen that there are actually three slots 74 formed in the J-slot sleeve 54, and there are correspondingly three lugs 72, each of the lugs being engaged in one of the slots. The lugs 72 are shown in two axial positions, and have been indicated with reference numerals "72*a*" and "72*b*". The lugs 72*a* are shown in their positions when the operating sleeve 52 is in its axially downwardly disposed position as described above and representatively illustrated in FIGS. 1A–1E. The lugs 72*b* are shown in their positions when the operating sleeve 52 is in its upwardly disposed position as described above and representatively illustrated in FIGS. 2A–2E.

When the operating sleeve 52 is axially displaced from its downwardly disposed position to its upwardly disposed position, the lugs 72 accordingly displace from position 72*a* to 72*b*. Since the slots 74 are circumferentially inclined, such axial displacement of the lugs 72 causes rotation of the J-slot sleeve 54 in one direction (to the left as viewed in FIG. 4). Conversely, axial displacement of the operating sleeve 52 from its upwardly disposed position to its downwardly disposed position causes the lugs 72 to displace from position 72*b* to 72*a*, thereby causing rotation of the J-slot sleeve 54 in the opposite direction (to the right as viewed in FIG. 4). Thus, the operating sleeve 52 may be axially displaced to produce a desired direction of axial rotation of the J-slot sleeve 54 and, since the J-slot sleeve is secured to the deflection member 14, axial displacement of the operating sleeve produces a corresponding rotation of the deflection member.

Thus has been described the wye block apparatus 10 which permits selective physical access to one of two fluid passages 20, 22 in a convenient manner, without requiring complex mechanisms, and with reduced sensitivity to debris therein. Of course, modifications, additions, deletions, substitutions, and other changes may be made to the representative embodiment of the present invention illustrated and described herein, which changes would be obvious to a person of ordinary skill in the art, and such changes are contemplated by the principles of the present invention. For example, the operating sleeve 52 could be provided with the slots 74 formed therein, and the J-slot sleeve 54 could be provided with the lugs 72 formed internally thereon. Accordingly, the foregoing detailed description is to be clearly understood as being given by way of illustration and example only, the spirit and scope of the present invention being limited solely by the appended claims.

What is claimed is:

1. Apparatus operatively positionable within a subterranean well, the apparatus comprising:

a generally Y-shaped housing having first, second and third fluid passages formed therein; and an elongated deflection member axially rotatably disposed at least partially within the housing.

2. The apparatus according to claim 1, wherein the deflection member has first and second opposite ends, the first end being aligned with the first fluid passage, and the second end being rotatably secured laterally between the second and third fluid passages.

3. The apparatus according to claim 1, wherein the deflection member has a guide surface formed thereon, the guide surface being alignable with a selected one of the second and third fluid passages.

4. The apparatus according to claim 1, wherein the deflection member has a generally tubular end portion, the end portion being rotatably disposed within the first fluid conduit.

5. The apparatus according to claim 1, wherein the deflection member is attached to a J-slot device, the J-slot device being configured to rotate the deflection member relative to the housing.

6. The apparatus according to claim 5, wherein the J-slot device is further configured to rotate a guide surface formed on the deflection member into alignment with a selected one of the second and third fluid passages.

7. The apparatus according to claim 1, wherein the deflection member is complementarily shaped relative to a portion of the housing laterally between the second and third fluid passages, and wherein the deflection member is axially rotatably engaged with the housing portion.

8. The apparatus according to claim 7, wherein the housing portion is an internal recess, and wherein the deflection member is received at least partially in the recess.

9. The apparatus according to claim 1, wherein the deflection member has an opening formed generally laterally therethrough, the opening permitting fluid communication between the first fluid passage and a selected one of the second and third fluid passages.

10. Apparatus operatively positionable within a subterranean well, the apparatus comprising:

an outer housing assembly having first and second opposite ends, the first opposite end having a first fluid passage formed therein, and the second opposite end having second and third fluid passages formed therein, the first fluid passage being in fluid communication with each of the second and third fluid passages; and an elongated deflection member having a guide surface formed thereon and a longitudinal axis, the guide surface being inclined along the longitudinal axis, and the deflection member being selectively rotatable about its longitudinal axis to a first position in which the guide surface is generally aligned with the second fluid passage, and a second position in which the guide surface is generally aligned with the third fluid passage.

11. The apparatus according to claim 10, wherein the guide surface is aligned with the first fluid passage in the first position and in the second position.

12. The apparatus according to claim 10, wherein one of the outer housing assembly and the deflection member has a recess formed thereon, and wherein the other of the outer housing assembly and the deflection member has a complementarily shaped projection formed thereon.

13. The apparatus according to claim 12, wherein the recess and projection are each conical shaped.

14. The apparatus according to claim 10, further comprising a J-slot device attached to the outer housing assembly and the deflection member.

15. The apparatus according to claim 14, wherein the J-slot device includes an axially reciprocably disposed sleeve, the sleeve being positionable in a selected one of a third position in which the deflection member is displaced to its first position, and a fourth position in which the deflection member is displaced to its second position.

16. The apparatus according to claim 15, further comprising a latch member, the latch member releasably securing the sleeve in a selected one of its third and fourth positions.

17. The apparatus according to claim 10, wherein the deflection member includes a generally tubular and longitudinally extending portion, the deflection member portion being received within the outer housing assembly and coaxially disposed relative to the first fluid passage.

18. A wye block apparatus, comprising:

a generally tubular fluid conduit having a first and second outlet ports and an inlet port, the first and second outlet ports extending in a first axial direction and the inlet port extending in a second axial direction opposite to the first axial direction, and a recess formed laterally between the first and second outlet ports;

a deflection member axially rotatably received within the fluid conduit, a first opposite end of the deflection member being aligned with the inlet port, and a second opposite end of the deflection member being received in the recess;

a first sleeve axially reciprocably disposed within the fluid conduit; and a second sleeve axially rotatably received within the fluid conduit and attached to the deflection member, the second sleeve being configured to rotate in response to axial displacement of the first sleeve.

19. The wye block apparatus according to claim 18, wherein the second sleeve has a helically formed contour thereon, and wherein the first sleeve has a generally radially extending projection formed thereon, the projection engaging the contour.

20. The wye block apparatus according to claim 18, wherein the first sleeve has a shifting pro file formed internally thereon.

21. The wye block apparatus according to claim 18, further comprising a resilient latch member disposed within the fluid conduit.

22. The wye block apparatus according to claim 21, wherein the first sleeve has an axially spaced apart series of latch engagement surfaces formed thereon, the latch member engaging corresponding ones of the latch engagement surfaces to releasably maintain the first sleeve in corresponding selected axial positions relative to the fluid conduit.

23. The wye block apparatus according to claim 18, wherein the deflection member is configured to rotate in response to rotation of the second sleeve.

24. The wye block apparatus according to claim 18, wherein the deflection member has an axially inclined and axially extending surface formed thereon, and wherein the surface is axially rotatable within the fluid conduit in response to axial displacement of the second sleeve.

25. The wye block apparatus according to claim 24, wherein the deflection member is rotatable to a selected one of a first position in which the surface is aligned with the first outlet port, and a second position in which the surface is aligned with the second outlet port.

* * * * *